US006312016B1

(12) United States Patent
Basich

(10) Patent No.: US 6,312,016 B1
(45) Date of Patent: Nov. 6, 2001

(54) SAFETY DEVICE AND METHOD FOR RECREATIONAL SNOW EQUIPMENT

(76) Inventor: Michael D. Basich, 8679 S. Sugerloaf Cir., Sandy, UT (US) 84093

( * ) Notice: Subject to any disclaimer, the term of this patent is extended or adjusted under 35 U.S.C. 154(b) by 0 days.

(21) Appl. No.: 09/483,810

(22) Filed: Jan. 15, 2000

Related U.S. Application Data

(60) Provisional application No. 60/116,104, filed on Jan. 15, 1999.

(51) Int. Cl.[7] ..... A63C 11/00
(52) U.S. Cl. ..... 280/809; 280/14.22
(58) Field of Search ..... 280/14.21, 14.22, 280/809, 816, 819, 821; 220/376, 377; 224/406, 408

(56) References Cited

U.S. PATENT DOCUMENTS

| | | | | |
|---|---|---|---|---|
| 4,082,302 | * | 4/1978 | Albrecht | 280/821 |
| 4,763,732 | * | 8/1988 | Neal | 220/377 |
| 4,949,996 | * | 8/1990 | McNally | 280/816 |
| 4,967,684 | * | 11/1990 | Vidovic et al. | 280/821 |
| 5,039,128 | * | 8/1991 | Romuno | 280/816 |
| 5,203,589 | * | 4/1993 | Tio | 280/816 |
| 5,246,133 | * | 9/1993 | James | 220/377 |
| 5,359,797 | * | 11/1994 | Williamson | 280/819 |
| 5,370,407 | * | 12/1994 | Whalen | 280/809 |
| 5,857,682 | * | 1/1999 | Hyman | 280/809 |
| 5,971,243 | * | 10/1999 | Peterson | 224/406 |

FOREIGN PATENT DOCUMENTS

| | | | | |
|---|---|---|---|---|
| 940818 | * | 3/1956 | (DE) | 280/816 |
| 3325819 | * | 12/1984 | (DE) | B63B/35/72 |
| 42994 | * | 1/1982 | (EP) | 280/816 |
| 2691075 | * | 11/1993 | (FR) | 280/816 |
| 2242039 | * | 9/1991 | (GB) | 280/816 |
| 88/07965 | * | 9/1989 | (WO) | 280/809 |

* cited by examiner

*Primary Examiner*—Frank Vanaman
(74) *Attorney, Agent, or Firm*—Crosby, Heafey, Roach & May

(57) ABSTRACT

An apparatus and method are provided for improving the safety of a snow-related recreational device. The apparatus is attachable to the equipment and preferably provides a function compatible with normal use of the equipment as well, such as functioning as a stomp pad for a snow board during snow board use. The apparatus preferably includes some means for determining the location of the equipment user should a risky situation, such as an avalanche or white-out develop. An instructional graphical display, explaining to a user the proper method of use of the location determining means, is preferably integral to the apparatus. The apparatus may be removeably attachable to the equipment to enable a user of multiple pieces of equipment, such as multiple snow boards, to move the apparatus from one piece to another.

12 Claims, 4 Drawing Sheets

SAFETY DEVICE AND METHOD FOR RECREATIONAL SNOW EQUIPMENT

CROSS-REFERENCE TO RELATED APPLICATIONS

This patent application claims the beneift of U.S. Provisional Patent No. 60/116,104 entitled Safety Device for Recreational Snow Equipment, filed Jan. 15, 1999, the entirety of which is incorporated herein by reference.

FIELD OF THE INVENTION

The invention relates generally to the field of safety devices for snow recreational equipment and more specifically to safety devices that are integral or attachable to snow recreational equipment.

BACKGROUND OF THE INVENTION

Hundreds of people are killed every year due to hazardous snow conditions, avalanches and blizzards around the world. Often these people are using commonly available snow recreational equipment (e.g., snowboards, skis, snow shoes, snow mobiles, cold weather camping equipment) and are not adequately prepared to detect and/or survive the hazardous snow conditions. There exists, therefore, a need for a safety device that can be utilized by a user of snow recreational equipment to detect and survive hazardous snow conditions.

One source of risk is the fact that the average user of available snow recreational equipment can not or will not bear the burden of carrying safety-related equipment other than standard recreational equipment and clothing for protection against the elements. For example, an Alpine- or Nordic-style skier will often only carry ski clothing, ski equipment, and some currency when the skier is heading out for a day on the slopes. Similarly, a snowboarder will only carry snowboard clothing, snowboard equipment, and some currency when the snowboarder is heading out for a day on a mountain—even if the snowboarder (or skier) intends to ski in "out of bounds" areas not normally patrolled by rescue or policing agencies. Despite the existence of such risks (some known and others not) most users of snow recreational equipment are unlikely to carry a safety device that provides any carrying burden in addition to the snow recreational equipment. There exists, therefore, a need for a safety device that is integral with or attachable to snow recreational equipment.

SUMMARY OF THE INVENTION

It is therefore a first advantage of the invention to address the shortcomings of the available art by providing a safety apparatus compatible with snow recreational equipment providing, integral therewith or attached thereto, one or more safety devices selected from a group including, but not limited to, a compass, a chronometer or sundial, a location signaling device, a thermometer, a barometer, an altimeter, a light reflector, or written instructions, preferably positioned on the equipment to provide the user easily-accessible, safety-related information. The inventive safety apparatus may be permanently or removeably attached to a piece of snow recreational equipment, and preferably provides some utility to the equipment user during normal use of the equipment.

It is a second advantage of the invention to provide a method of self-rescue from a snow-related emergency situation using an inventively enabled piece of snow recreational equipment, the method comprising observing a need for a safety or rescue related apparatus, retrieving the needed apparatus from a piece of recreational equipment, and utilizing the needed apparatus in a manner displayed by the piece of equipment.

It is a third advantage of the invention to provide a removeably attachable apparatus for improving the safety of a snow-related recreational device, the apparatus comprising attachment means for removeably attaching the apparatus to the device, determining means for determining the location of the apparatus when attached to the device, and instructional information, comprising text and/or graphics, explaining to a user the proper method of use of the determining means, wherein the determining means comprises at least one member of the group consisting of a compass, a chronometer or sundial, a location signaling device, a thermometer, a barometer, an altimeter, or a light reflector.

It is a fourth advantage of the invention to provide an apparatus and method improving the safety of a snow-related recreational device. The apparatus is attachable to the equipment and preferably provides a function compatible with normal use of the equipment as well, such as functioning as a stomp pad for a snow board during snow board use. The apparatus preferably includes some means for determining the location of the equipment user should a risky situation, such as an avalanche or white-out develop. An instructional graphical display, explaining to a user the proper method of use of the location determining means, is preferably integral to the apparatus. The apparatus may be removeably attachable to the equipment to enable a user of multiple pieces of equipment, such as multiple snow boards, to move the apparatus from one piece to another.

BRIEF DESCRIPTION OF THE DRAWINGS

The aforementioned advantages of the invention as well as additional advantages thereof will be more clearly understood hereinafter as a result of a detailed description of a preferred embodiment of the invention when taken in conjunction with the following drawings in which.

DETAILED DESCRIPTION OF A PREFERRED AND ALTERNATIVE EMBODIMENTS

Although the invention may be used in conjunction with various forms of snow recreational equipment (e.g., skies, snowboards, snow mobiles, snow shoes, camping gear and the like) the preferred embodiments of the invention are described, in the interest of clarity, as attached to or integral with a snowboard. Thus, it is considered within the ability of one skilled in the art to which the invention pertains to apply the teachings of the invention to other forms of snow recreational equipment.

In order to provide context for explaining the invention, a description of the operation of an exemplary snowboard is provided. A snowboard provides a method of sliding across snow by means of a single ski-like device. The snowboarder attaches both feet to separate bindings on a single snowboard and glides downhill without using ski poles. A snowboard user is able to use gravity to glide down slopes, but, because he has both feet attached to the snowboard, he has no means of forward propulsion when stationary and on level or upwardly sloping ground. Therefore, in the absence of momentum, a snowboard user on level or upwardly sloping ground must remove a foot from the snowboard binding and use it against the ground to push-off, in order to glide forward. The push and glide sequence is repeated to continue forward movement. The rearward foot is used to push off, which may be the left or the right foot, depending upon the user's preference.

Pushing off on a rearward foot is effective as a means for propulsion but ineffective as a means for controlling the direction of motion and maintaining balance. When both feet are attached to the bindings , the snowboard is normally steered by shifting weight, or leaning, into the direction of the desired turn. This means of steering is significantly less effective when the rearward foot is outside the binding and merely sitting on the snowboard than it is with both feet securely attached to the snowboard by bindings. When the rearward foot is not in the binding, the foot slides about on the slippery snowboard surface, making it difficult to put weight on the rearward foot and to use it for balance or steering.

To provide the rearward foot with a modicum of control when it is not in the binding, snowboard users typically affix a non-slip surface to their snowboards for the purpose of resting their rearward foot thereupon. This non-slip surface is often called a snowboard grip, a foot grip, or a stomp pad.

Figure 1:
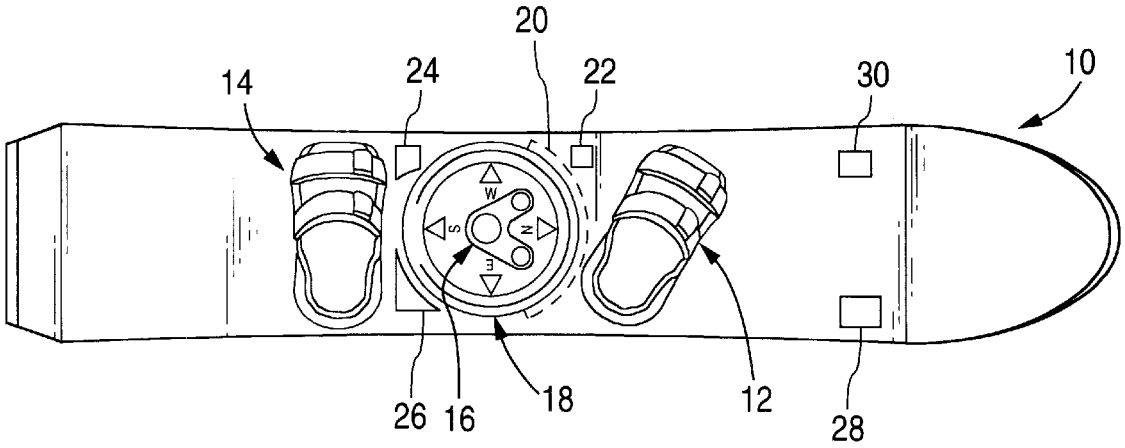
FIG. 1 is a top plan view of an exemplary snowboard having safety graphics and devices of the invention attached thereto.

Referring now to FIG. 1, a snowboard 10 incorporating a preferred embodiment of the apparatus of the invention is shown. Snowboard 10 includes a front foot binding 12 and a rear foot binding 14 mounted on an upper surface thereof. A stomp pad 16 containing a plurality of safety devices (described in detail below with reference to FIG. 3) is attached to the upper surface of snowboard 10. Stomp pad 16 is fabricated from a plastic or rubber mold and has an adhesive on a lower surface thereof and a friction surface on an upper surface thereof, as discussed above. Stomp pad 16 is attached or mounted to the upper surface of the snowboard 10 via the adhesive. In operation, the user uses stomp pad 16 as a non-slip surface to rest a rearward foot thereon and as a mounting region for supporting the safety devices of the invention, as discussed below. Although stomp pad 16 is described as attaching to snowboard 10 via an adhesive layer, other attachment mechanisms known by those skilled in the art, such as, but not limited to, bolts, screws, and interlocking engagement members, are considered within the scope of the invention.

A graphical design region 18 is provided on an upper surface of snow board 10 between front foot binding 12 and a rear foot binding 14. Graphical design region 18 includes a sundial area 20 and snow safety information 22, 24, and 26 that describes the operation of sundial area 20 as well as methods for examining snow conditions to detect avalanche conditions at various degrees of mountain slopes, as discussed in further detail below.

A signal reflector 28 is attached to the upper surface of snow board 10. Signal reflector 28 is fabricated from a reflective material having an adhesive backing that facilitates the attachment of signal reflector 28 to snowboard 10. In operation, the user utilizes the reflector to reflect sunlight to signal messages to distant observers. One exemplary message is a message requesting assistance in an emergency situation.

A location device 30 for enabling the user to locate a lost snowboard or enabling rescuers to locate a lost snowboarder is attached to the upper surface of snowboard 10. An exemplary location device is the Recco® rescue system Manufactured by Recco AB of Sweden. The Recco® rescue system is an electronic device used to locate avalanche victims. The system includes a detector and a reflector. The detector contains a transmitter and a receiver. The reflector contains a thin printed circuit card protected by a plastic covering. The reflector can be affixed to the upper surface of a user's snowboard. The reflector weighs a few grams and has an unlimited lifetime if it does not suffer heavy damage. In operation, the Recco® rescue system utilizes a frequency doubling principle. The detector transmits a directional signal that, upon encountering the reflector, is doubled and sent back towards the detector. Upon reception of the doubled signal, the detector transmits a tone to a rescuer, e.g. via a pair of headphones, that indicates the detection of the reflector.

Figure 2:
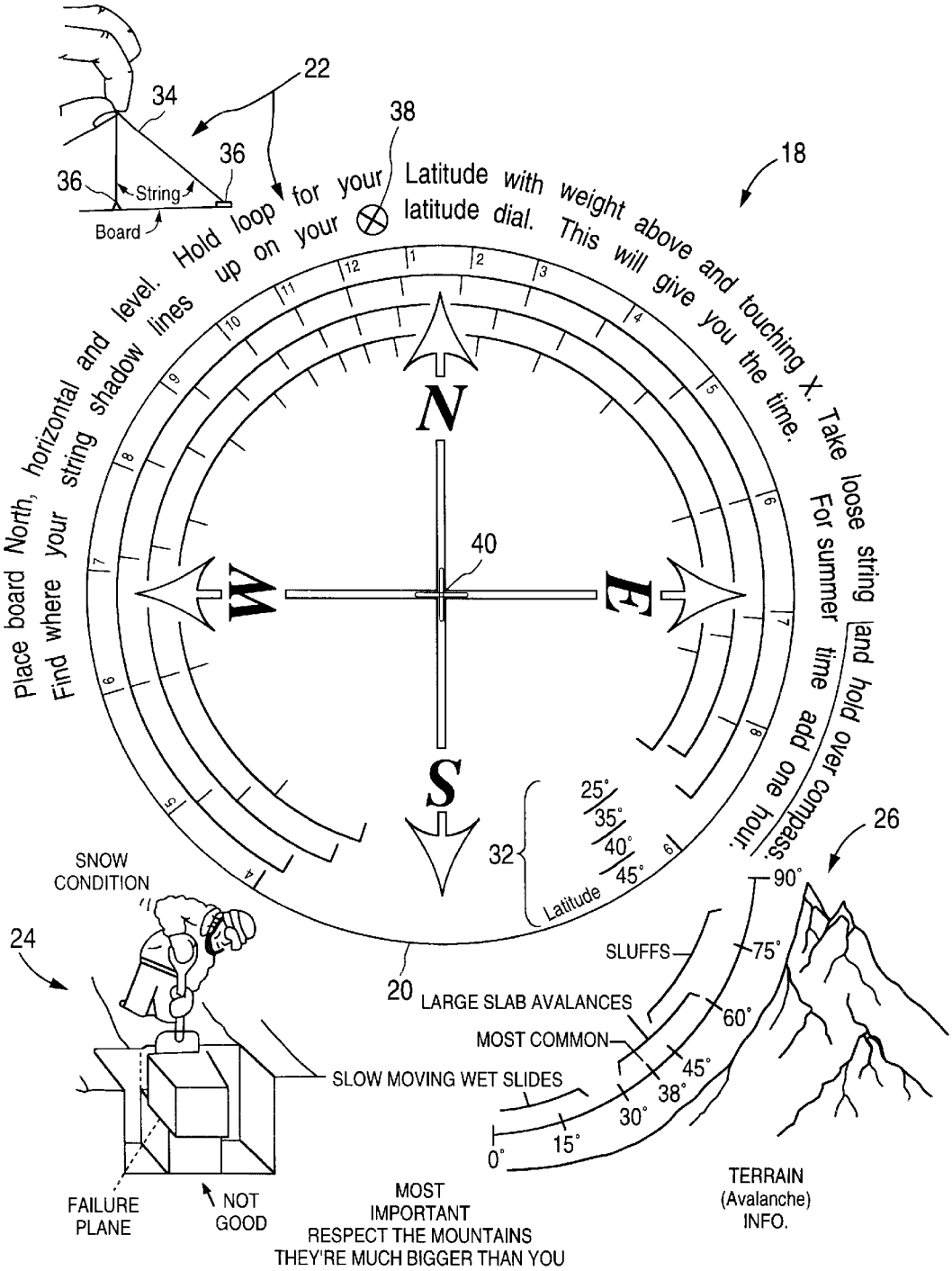
FIG. 2 is a diagrammatic view of the graphical portion of the invention illustrated in FIG. 1.

Referring now to FIG. 2, graphical design region 18 is shown in further detail. As discussed above, graphical design region 18 includes a sundial 20. Sundial 20 calculates the time for four different latitudes as indicated by latitude loops or bars 32. In order for a user to determine which latitude to utilize, the user can consult an almanac, map or global position satellite (GPS) system before the user begins to snowboard at a selected location. In the alternative, the user may carry a GPS unit, or one may be affixed to the snowboard in accordance with the method and system of the invention. Sundial 20 is compatible with and preferably includes, stored thereupon, a string 34 having weights 36 on the ends thereof (shown graphically in instruction region 22). In operation, the user points the north (front) end of the board towards the north. (It should be noted that the user can use a compass (described below) to confirm that the snowboard is aligned properly). Next, the user positions one weight 36 on a first gnomon marker (either 28 or 30, depending upon the positioning of stomp pad 16 relative to snowboard 10 for either and right-leg dominant user or a left-leg dominant user) and one weight 36 on a second gnomon marker 40 that bisects a line connecting the center lines on sundial 20. Afterwards, the user pulls string 34 such that string 34 is vertical between the user's fingers and gnomon marker 40 and is sloped between the user's fingers and gnomon marker 38. Finally, the user determines where the string's shadow crosses the relevant latitude loop 32 and detects the time of day. It should be noted that the detected time should be adjusted, if necessary, for daylight savings.

Snow safety information regions 24 and 26 inform the user of detection techniques for determining snow conditions. More particularly, region 24 illustrates a technique for manually testing the snow for a failure plane and region 26 illustrates likely snow conditions at varying degrees of mountain slope.

Figure 3:
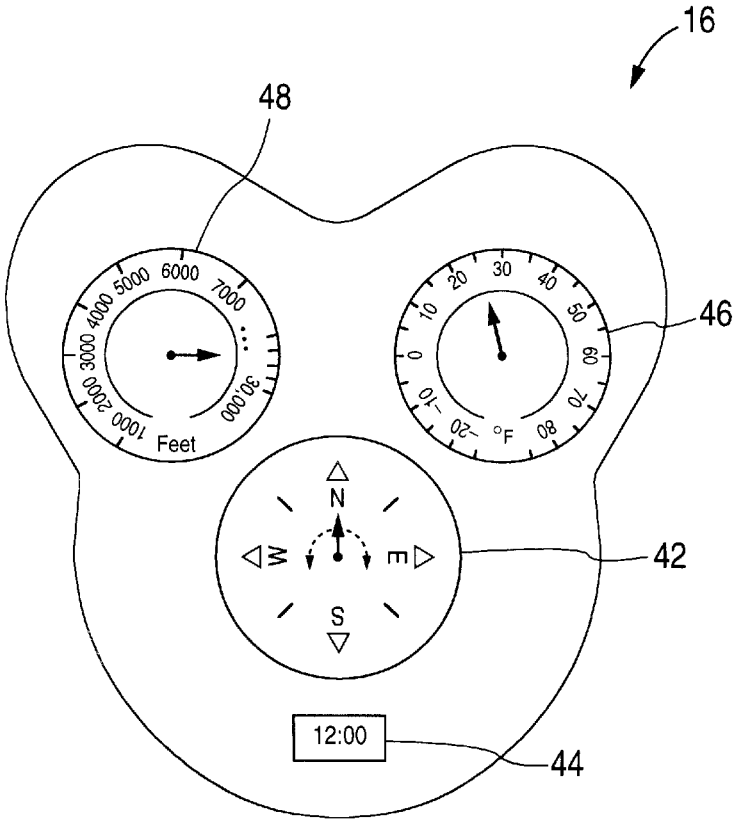
FIG. 3 is a top plan view of a stomp pad containing the safety devices of the invention illustrated in FIG. 1.

Referring now to FIG. 3, stomp pad 16 of the invention is shown. As discussed above, stomp pad 16 contains a plurality of safety devices. One safety device is a compass 42 for providing directional information to a user when the user is reading a map or in low visibility conditions, e.g., during a snow storm. As discussed above, compass 42 is preferably used to ensure the proper alignment of sundial 20. Compass 42 is preferably removeably insertable into stomp pad 16 to ease map reading in a manner independent of snowboard 10. Another safety device is a digital time piece 44 for providing the user with the time of day. It should be noted that digital time piece 44 can be used together with or in lieu of sundial 20. A further safety device is a thermometer 46 for measuring the temperature of the surrounding environment. If the undersurface of snowboard 10 rests on the snow, thermometer 46 measures the temperature of the snow. This measurement facilitates the users ability to choose a wax for the snowboard bottom (not shown) that corresponds to the condition of the snow. If the user holds snowboard 10 in a vertical position (or places an end of the snowboard in the snow), thermometer 46 measures the temperature of the surrounding air. A still further safety device is an altimeter 48 for determining an altitude in which the user is snowboarding. The altitude reading can be used by the user to determine whether bottled oxygen is required.

Figure 4:
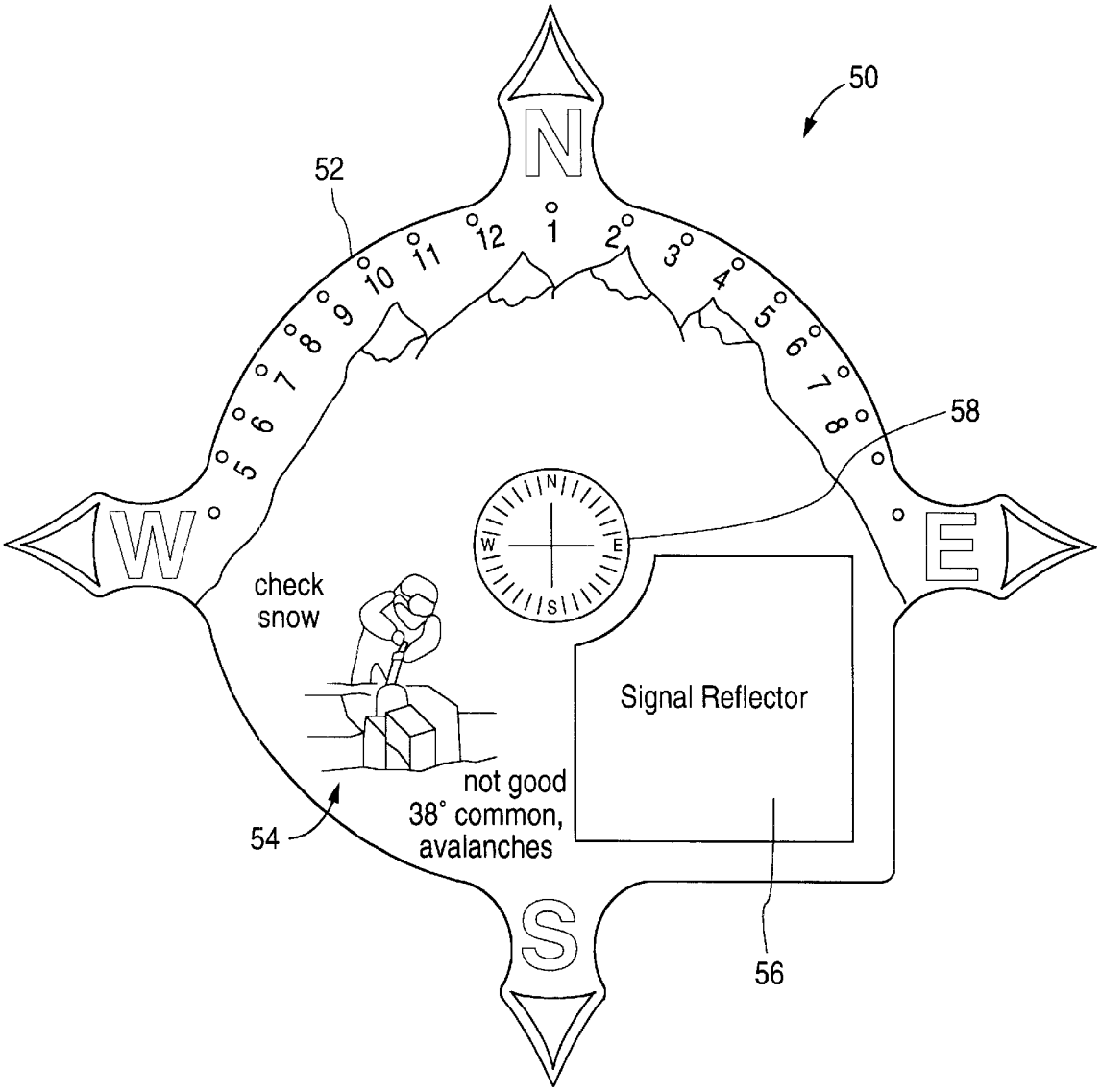
FIG. 4 is a top plan view of safety graphics and devices integrated onto a stomp pad of the invention.
Figure 5:
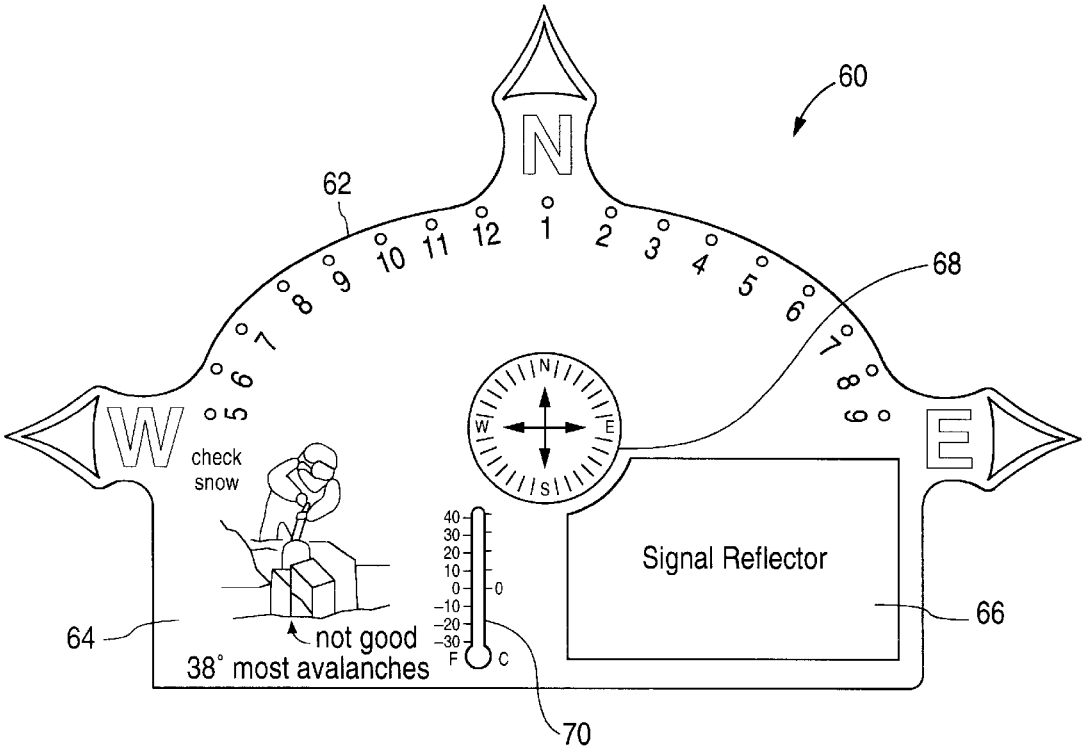
FIG. 5 is a top plan view illustrating safety graphics and devices integrated onto an alternative stomp pad of the invention.

Referring now to FIGS. 4 and 5, the graphical safety design region is preferably provided on a stomp pad containing a plurality of safety devices. In a preferred embodiment, the stomp pad is fabricated from a transparent plastic (or rubber) and the graphical safety design region is printed on an undersurface thereof such that the user can view the graphical design region while the region is protected by the stomp pad. Turning now to FIG. 4, one embodiment of an integrated stomp pad 50 includes a sundial 52, avalanche safety information 54, a signal reflector 56, and a compass 58. Turning now to FIG. 5, another embodiment of an integrated stomp pad 60 includes a sundial 62, avalanche safety information 64, a signal reflector 66, a compass 68, and a thermometer 70.

While the invention has been described with reference to certain preferred embodiments, those skilled in the art to which the invention pertains will now, as a result of the applicant's teachings herein, recognize that various modifications and other embodiments may be provided. By way of example, the illustrated stomp pads can be modified for attachment to a ski or a snowmobile. These and other variations upon and modifications to the embodiment described herein are deemed to be within the scope of the invention which is to be limited only by the appended claims. Moreover, the corresponding structures, materials, acts, and equivalents of all means or step plus function elements in the claims are intended to include any structure, material, or acts for performing the functions in combination with other elements as specifically claimed.

What is claimed is:

1. A snowboard having a free area between a first binding position and a second binding position, comprising:

safety related equipment attached to said free area; wherein:

said safety related equipment comprises a dial shaped indicator having a diameter of approximately the size of a snowboard boot footprint; and said safety related equipment includes a stomp pad integrated on top of the safety related equipment; wherein:

said safety related equipment is a compass and said dial shaped indicator is a compass face;

said safety related equipment includes an integrated clear material cover over said dial shaped indicator; and said stomp pad comprises a set of foot gripping points attached to said cover but not obscuring view of the safety related equipment display.

2. The snowboard according to claim 1, further comprising a reflector integrated into the compass face.

3. The snowboard according to claim 1, wherein said safety related equipment further includes instructions and graphics printed on and around said dial for determining each of latitude, snow condition, including a failure plane of the snow, and terrain information.

4. The attachment according to claim 3, wherein said instructions include pointers to specific points of said graphics that indicate a determination of a failure plane in snow and pointers to slopes indicated on the terrain information where avalanches are most and least likely to occur.

5. The attachment according to claim 4, wherein said safety related equipment is configured to be removably attached to a snowboard.

6. The snowboard according to claim 3, wherein said safety related equipment further comprises a locator device for signaling a location of the snowboard.

7. The snowboard according to claim 1, wherein said safety related equipment comprises a plurality of safety related items.

8. The snowboard according to claim 7, wherein:

said plurality of safety related items include, in addition to said compass, an altimeter, a thermometer, and a clock; and said dial shaped indicator further includes dials for each of said altimeter, and said clock.

9. The snowboard according to claim 1, wherein:

said compass face further comprises graphics and text indicating how to determine a failure plane of snow;

said graphics include a person performing a snow failure plane analysis and pointers to a graphical failure plane; and said text includes a description of the graphics.

10. The snowboard according to claim 1, wherein said safety related equipment further includes at least one of an altimeter, a clock, a thermometer, instructions for determining a failure plane of snow, graphics illustrating how to determine a failure plane of snow, avalanche information, graphics illustrating avalanche likelihood determination, a reflector, and a latitude determination mechanism.

11. The attachment according to claim 1, wherein the dial shaped indicator is circular.

12. The attachment according to claim 1, wherein:

said safety related equipment comprises, in addition to said compass, an altimeter, a thermometer, and a clock, and instructions on said display for determining each of a failure plane of snow, avalanche likelihood, and latitude; wherein:

said instructions include graphics showing a person performing failure plane determination and example mountain terrain.

* * * * *